US005746681A

United States Patent [19]

Bull

[11] Patent Number: 5,746,681

[45] Date of Patent: May 5, 1998

[54] WALKING EXERCISE MACHINE

[76] Inventor: John W. Bull, 2502 Wedgewood Ct., Olympia, Wash. 98501

[21] Appl. No.: 798,667

[22] Filed: Feb. 11, 1997

Related U.S. Application Data

[63] Continuation-in-part of Ser. No. 597,608, Feb. 6, 1996, abandoned.

[51] Int. Cl.[6] ..... A63B 22/04

[52] U.S. Cl. ..... 482/53; 482/51

[58] Field of Search ..... 482/51, 52, 53, 482/57, 70, 71, 74

[56] References Cited

U.S. PATENT DOCUMENTS

| | | | |
|---|---|---|---|
| 3,747,924 | 7/1973 | Champoux | 272/79 |
| 4,591,032 | 5/1986 | Itazu | 188/313 |
| 4,850,585 | 7/1989 | Dalebout | 482/51 |
| 4,940,233 | 7/1990 | Bull et al. | 482/51 |
| 5,000,443 | 3/1991 | Dalebout et al. | 482/51 |
| 5,183,448 | 2/1993 | Wang | 482/52 |
| 5,242,343 | 9/1993 | Miller | 482/57 |
| 5,263,909 | 11/1993 | Ehrenfried | 482/52 |
| 5,284,461 | 2/1994 | Wilkenson | 482/53 |
| 5,290,211 | 3/1994 | Stearns | 482/53 |
| 5,299,993 | 4/1994 | Habing | 482/52 |
| 5,336,142 | 8/1994 | Dalebout et al. | 482/51 |
| 5,336,143 | 8/1994 | Wu | 482/52 |
| 5,352,169 | 10/1994 | Eschenbach | 482/57 |
| 5,391,130 | 2/1995 | Green et al. | 482/71 |
| 5,401,226 | 3/1995 | Stearns | 482/53 |
| 5,419,747 | 5/1995 | Piaget | 482/51 |
| 5,496,235 | 3/1996 | Stevens | 482/51 |

*Primary Examiner*—Stephen R. Crow
*Attorney, Agent, or Firm*—F. Eugene Logan

[57] ABSTRACT

A non-impact exercise machine which can be used by people of all ages, requiring no special dexterity or athletic ability to perform and exerting minimal impact on the muscles and joints of the user, providing a light weight, collapsible, and affordable indoor exercise machine for simulating walking. One embodiment of the exercise machine comprises a support structure; and, right and left platforms for standing on by the use's right and left foot respectively in an approximately horizontal position; and, right and left linkage assemblies pivotably disposed on the support structure about a right and left upper pivot axis and the right and left platforms, the platforms movable in a fixed path below the right and left upper pivot axis; and, a resistance system for resisting the movement of the right and left platforms. In one embodiment of the exercise machine the right and left linkage assemblies comprising right and left, first and second members having their first ends pivotably mounted on the support structure about a right and left upper first and second pivot axis respectively and their opposite free ends pivotably mounted to the right and left platforms respectively, the platforms moveable in a fixed path below the right and left upper first and second pivot axis.

22 Claims, 9 Drawing Sheets

WALKING EXERCISE MACHINE

This application is a continuation-in-part of application Ser. No. 08/597,608, filed Feb. 6, 1996, now abandoned.

BACKGROUND—FIELD OF INVENTION

This invention relates to equipment used to enhance physical fitness and more specifically to equipment that is gentle on the joints and muscles of the user and simulates walking.

BACKGROUND—DESCRIPTION OF PRIOR ART

A wide variety of exercise devices have been developed for exercising various muscle groups of the human body and for simulating walking, but none provide the simplicity and effectiveness of the non-impact walking exercise machine.

Treadmills are common and well-known exercise machines capable of providing aerobic conditioning, but are large and cumbersome with many moving parts that require constant periodic maintenance. Treadmills are complex and expensive, requiring frequent lubrication of their slider decks, and frequent adjustment of their tail pulley for proper belt tracking.

The typical treadmill is large and heavy and nearly impossible to store within a closet, requiring the treadmill to have a dedicated location within the home. The treadmill deck also imparts a jolt to the joints of the user's body when walking. stairclimbers are an intense form of exercise and difficult to use except by individuals that are in good physical condition and have knees capable of withstanding the deep knee bending motion.

Stairclimbers have a near vertical climbing motion that applies considerable pressure to the knees of the user. The repetitive climbing motion is very difficult for the knee to sustain, frequently resulting in pain and inflammation of the knee joint, excluding many individuals from their use.

U.S. Pat. No. 5,401,226 dated Mar. 28, 1995, and U.S. Pat. No. 5,299,993 dated Apr. 5, 1994 shows an exercise device with a base support and two foot supports and multiple linking assemblies operatively connecting the foot supports to the base support. The foot supports free to travel in generally an ovate envelope or free to move in generally a vertical, or horizontal motion, depending on their use.

SUMMARY OF THE INVENTION

There are many known methods of maintaining physical fitness, but none more common or more highly recommended than walking. The medical benefit of walking on a regular basis has been the subject of many published medical reports as an important ingredient for maintaining cardiovascular health. Beyond the cardiovascular benefits of walking there are the benefits of an improved sense of well-being, vigor and vitality. It has also been reported by public health authorities that one should try and exercise at least thirty minutes per day to avoid the many possibly health risks of a sedentary life style.

Exercise on an ongoing basis for many people places a great deal of demands on an individual's time, requiring a convenient means of exercise to achieve one's goal of maintaining physical fitness. Almost everyone is capable of walking, it's easy on the joints and doesn't require any special athletic ability or dexterity to perform. In order to maintain an ongoing program to achieving physical fitness, exercise must be convenient and also capable of being performed at one's own home to remain consistent.

This invention solves to a large extent the above-mentioned needs. The non-impact walking exercise machine provides a gentle means of exercise capable of being performed by almost everyone.

Accordingly, there is provided by the principles of this invention an non-impact walking exercising machine in which the exercise is performed in a smooth, shock-free manner with minimal impact stress exerted on the muscles and joints of a user's body.

An object of this invention is to provide an exercise machine in which forward to backward to forward movement of a user's foot and leg provide an non-impact exercise routine simulating walking.

Another object of this invention is to provide an exercise machine in which shifting weight from one foot to the other foot simulates walking.

Still another object of this invention is to provide an exercise machine in which a user's weight bearing foot will move from a forward position to a rearward position.

Another object of this invention is to provide an exercise machine in which the horizontal movement of the user's foot is greater than the vertical movement of the user's foot.

Another object of this invention is to provide an exercise machine in which the vertical and horizontal movement of a user's foot and leg defines a step. The combined and repetitive horizontal and vertical movement of the user's feet and legs combine to simulate walking.

Yet another object of this invention is to provide an exercise machine that provides a convenient and easy, non-impact walking motion capable of being performed by most individuals and providing an inexpensive way to maintain physical condition, burn calories and reduce excess weight within a user's own dwelling.

Still another object of this invention is to provide an exercise machine that simulates walking and maintains the user's feet in an approximate horizontal position.

Another object of this invention is to provide an exercise machine in which a user's non-weight bearing foot will return to a forward position.

Still another object of this invention is to provided an exercise machine in which the user can quickly and easily adjust the rate or speed in which they walk.

One embodyment of the exercising machine comprises a support structure with right and left swing arm assemblies pivotably mounted on the support structure. The right and left swing arm assemblies are for supporting a user's right and left foot respectively in an approximate horizontal position. The right and left swing arm assemblies are operable for rotating in principally a forward to rearward to forward motion. The exercise machine also comprising a resistance system for resisting the movement of the right and left swing arm assemblies.

In one embodyment of the exercise machine the resistance system comprises a right and left resistance cylinder for resisting the movement of the right and left swing-arm assemblies.

In one embodyment of the exercise machine the right and left resistance cylinders control the speed of the right and left swing arm assemblies.

In one embodyment of the exercise machine the right and left resistance cylinders are adjustable for controlling the speed of the right and left swing arm assemblies.

In one embodyment of the exercise machine the right and left swing arm assemblies are biased in a forward direction.

In one embodyment of the exercise machine the first ends of the right and left resistance cylinders are pivotably mounted on the support structure, and the opposite free ends are pivotably mounted on the right and left swing-arm assemblies.

In one embodyment of the exercise machine the right resistance cylinder returns the right swing arm assembly to a forward position when substantially all the user's weight is on the left swing arm.

In one embodyment of the exercise machine the left resistance cylinder returns the left swing arm assembly to a forward position when substantially all the user's weight is on the right swing arm assembly.

In one embodyment of the exercise machine the right swing arm assembly comprises a right first and second member with first ends pivotably mounted on a portion of the support structure about a right upper first and second pivot axis.

In one embodyment of the exercise machine the left swing arm assembly comprises a left first and second member with first ends pivotably mounted on a portion of the support structure about a left upper first and second pivot axis.

In one embodyment of the exercise machine the right and left swing arm assemblies comprise a right and left platform respectively. The right and left platforms are pivotably mounted to the opposite free ends of the right and left, first and second members respectively. The right and left platforms are operable in a fixed path below the elevation of the right and left upper first and second pivot axis, respectively.

In this invention walking is simulated by the fixed paths in which the platform means of the exercise machine are constrained to move. In particular, when using this invention, the instant at which the user's body weight begins to shift from the rearmost platform means to the forwardmost and uppermost platform means occurs when the rearmost platform means is at or near the lowest point along its fixed path. At this instant the user's rearward leg knee is straight and the forward leg knee is bent, which simulates very closely walking.

Therefore just as the user's body weight shifts from one foot on one platform means to the other foot on the other platform means, the movement to the rear of the first platform means momentarily comes to a stop along the fixed path.

Momentary stops occur alternately and sequentially at approximately the lowest point along each fixed path. It is readily understood that the lowest point along each fixed path occurs when the lower pivot axes are vertically directly under the corresponding upper pivot axes.

In one embodiment to achieve this result in this invention, i.e. a simulated walking, each of the platform means are biased towards the forwardmost and uppermost position so that as the user's body weight shift from one foot on the rearmost platform means to the other foot on the forwardmost platform means, the rearmost platform means with less and less user's weight will begin to return to the forwardmost and uppermost position while the forwardmost platform means will begin to move rearward as the user's body weight is shifted to it.

In another embodiment, the exercise machine includes bias means for returning the right and left platform means to their forwardmost and uppermost terminal positions when there is little or no downward external force on the platform means.

In this embodiment, the right and left resistance means are adjustable and are operable for controlling the speed of the swing arm assemblies so that a heavier user can increase the resistance and a lighter user can decrease the resistance by the resistance means.

Accordingly, besides the objects and advantages of the non-impact walking exercise machine described above, additional objectives and advantages of the present invention are:

(a) to provide a exercise machine which involves the major muscle groups of the human body and is gentle on the user's joints while providing a vigorous cardiovascular workout, (b) to provide a exercise machine which is easy to use, requiring no special dexterity or athletic ability to perform, regardless of the user's size or age, (c) to provide a exercise machine which is inexpensive and affordable relative to other forms of indoor exercise equipment, (d) to provide a exercise machine which requires a minimal amount of floor space, is light-weight and easy to lift, and foldable for simple and easy storage, (e) to provide a exercise machine which is silent when in use and can be used while watching television or listening to music undisturbed by noise from the exercise machine, (f) to provide a exercise machine which does not require special maintenance procedures, (g) to provide a exercise machine which is easy to manufacture with known methods of mass-production.

Still further objectives and advantages of the non-impact walking exercise machine will become apparent from a consideration of the ensuing description and drawings.

BRIEF DESCRIPTION OF THE DRAWING FIGURES

DESCRIPTION OF THE PREFERRED EMBODYMENT

Figure 2:
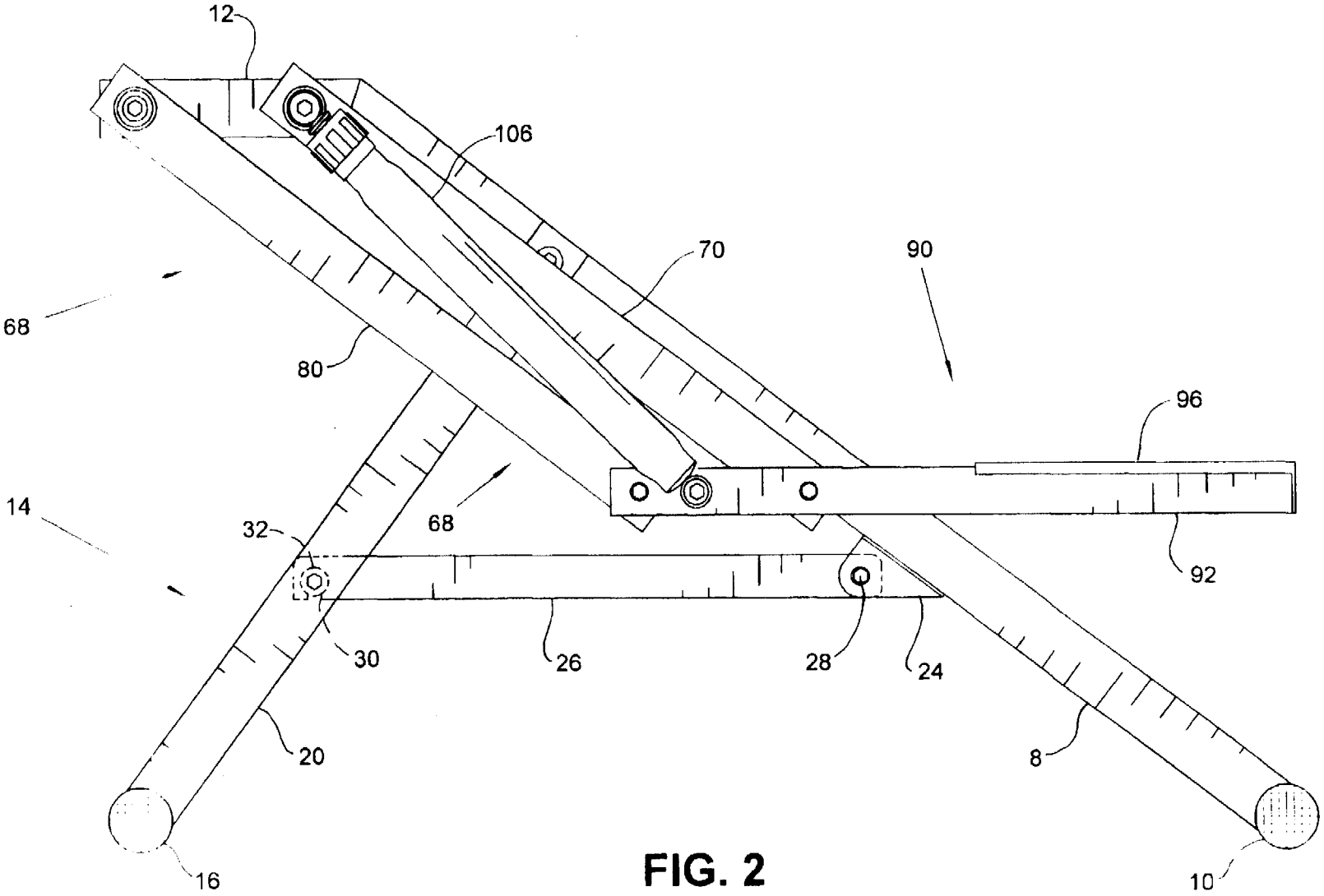
FIG. 2 is a right side elevational view of the machine.
Figure 3:
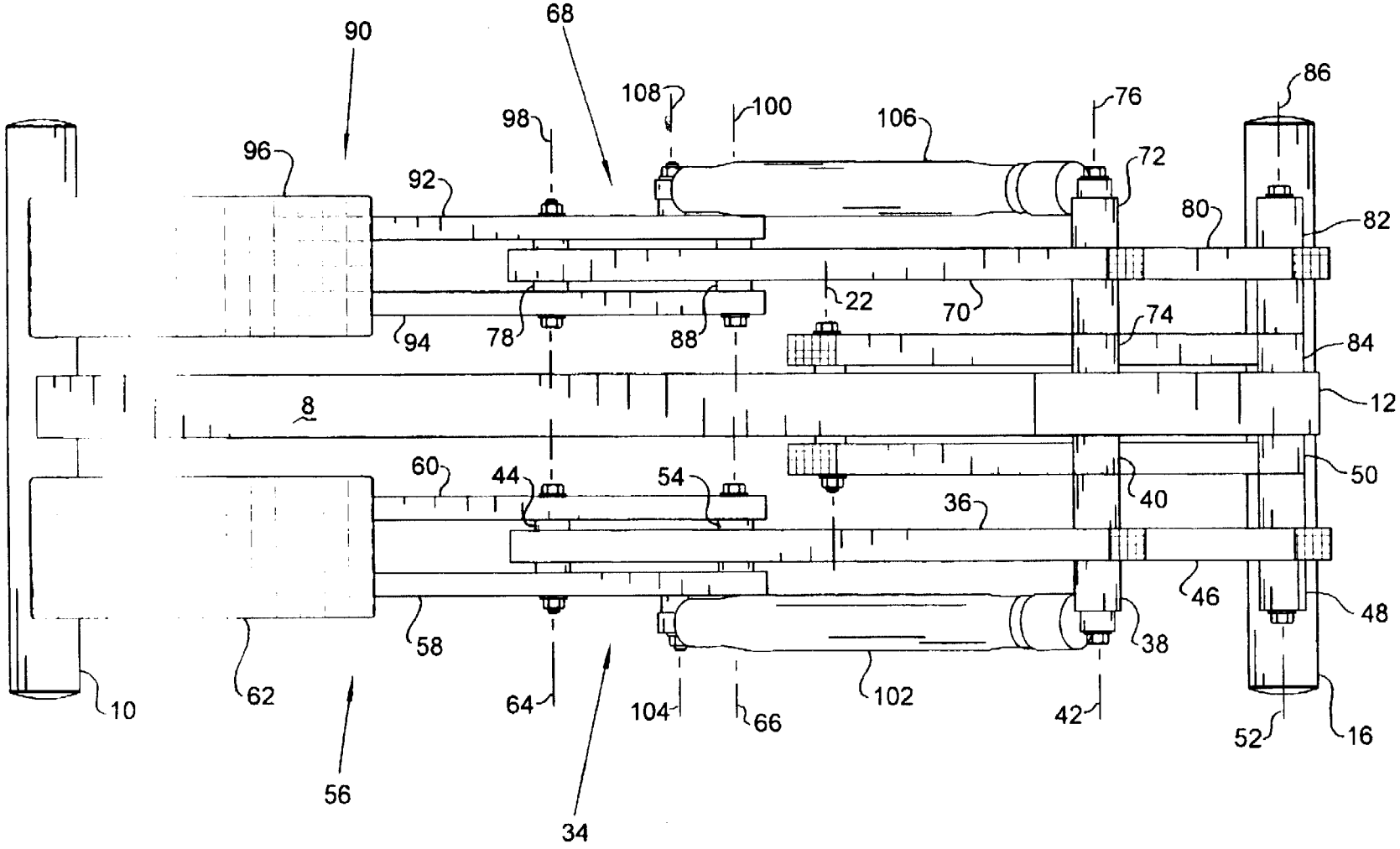
FIG. 3 is a top plan view of the exercise machine.
Figure 4:
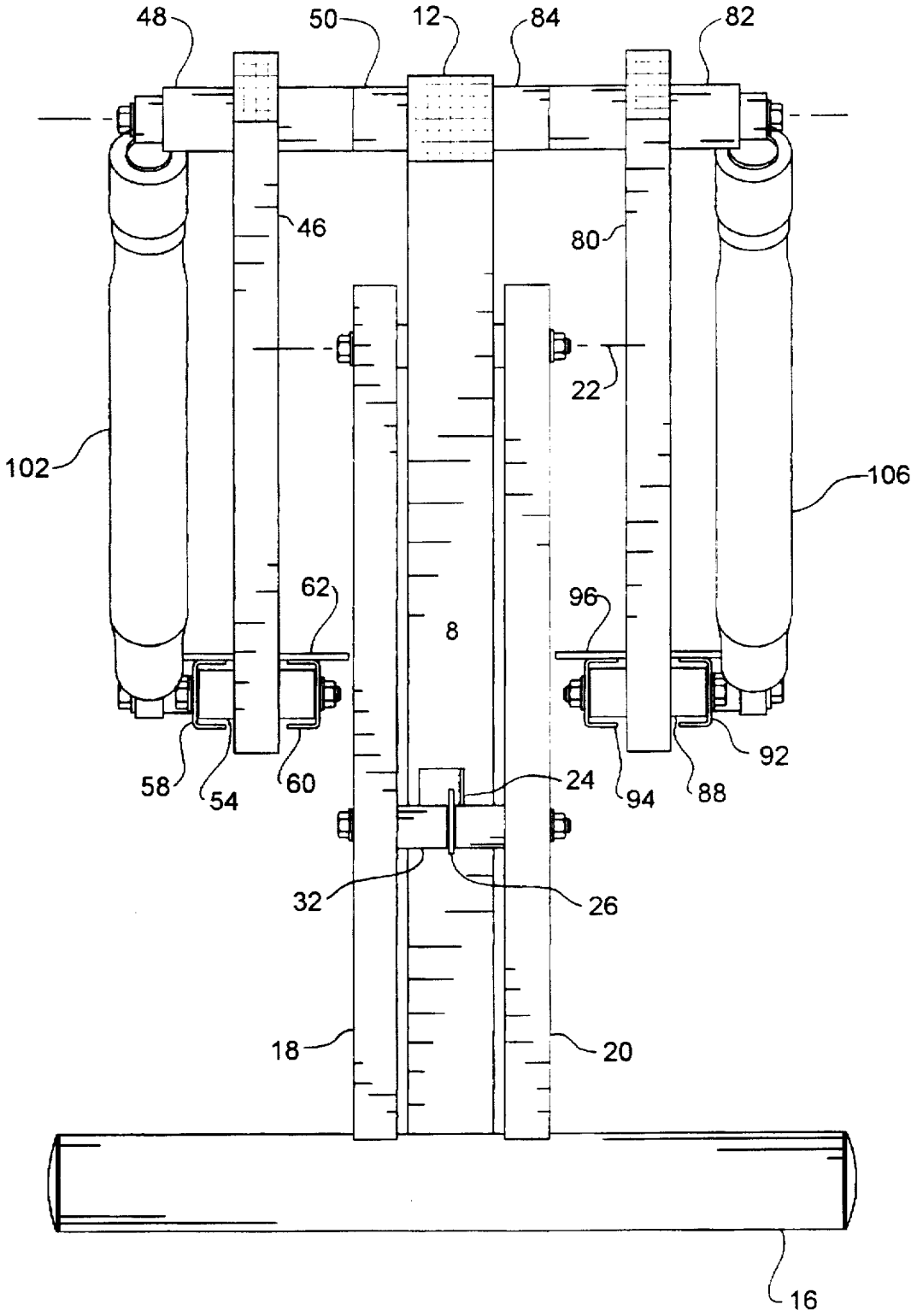
FIG. 4 is a back side elevational view of the exercise machine.

A typical embodyment of the exercise machine of the present invention is illustrated in FIGS. 1 to 4. In FIGS. 4 and 5 both the left and right platform means are at their forwardmost and uppermost positions. The exercise machine comprises longitudinal frame member 8 that is welded at its first end near the mid-section of front lateral base frame member 10. Longitudinal frame member 8 extends diagonally up from the front lateral base frame member 10 to the first end of horizontal frame member 12. Horizontal frame member 12 is welded to longitudinal frame member 8 opposite it's first end.

The rear tail assembly 14 is pivotably mounted to longitudinal frame member 8, shown in FIGS. 1 to 4. The rear tail assembly 14 comprises rear lateral base member 16, and longitudinal tail members 18 and 20. The first ends of longitudinal tail members 18 and 20 are each welded near the mid-section of rear lateral base member 16.

The longitudinal tail members 18 and 20 are spaced sufficiently apart from one another to be pivotably mounted between longitudinal frame member 8 opposite their first ends about rear-tail pivot axis 22, shown in FIGS. 3 and 4. Front and rear lateral base members 10 and 16 respectively provide lateral stabilization of the exercise machine when in use.

Figure 1:
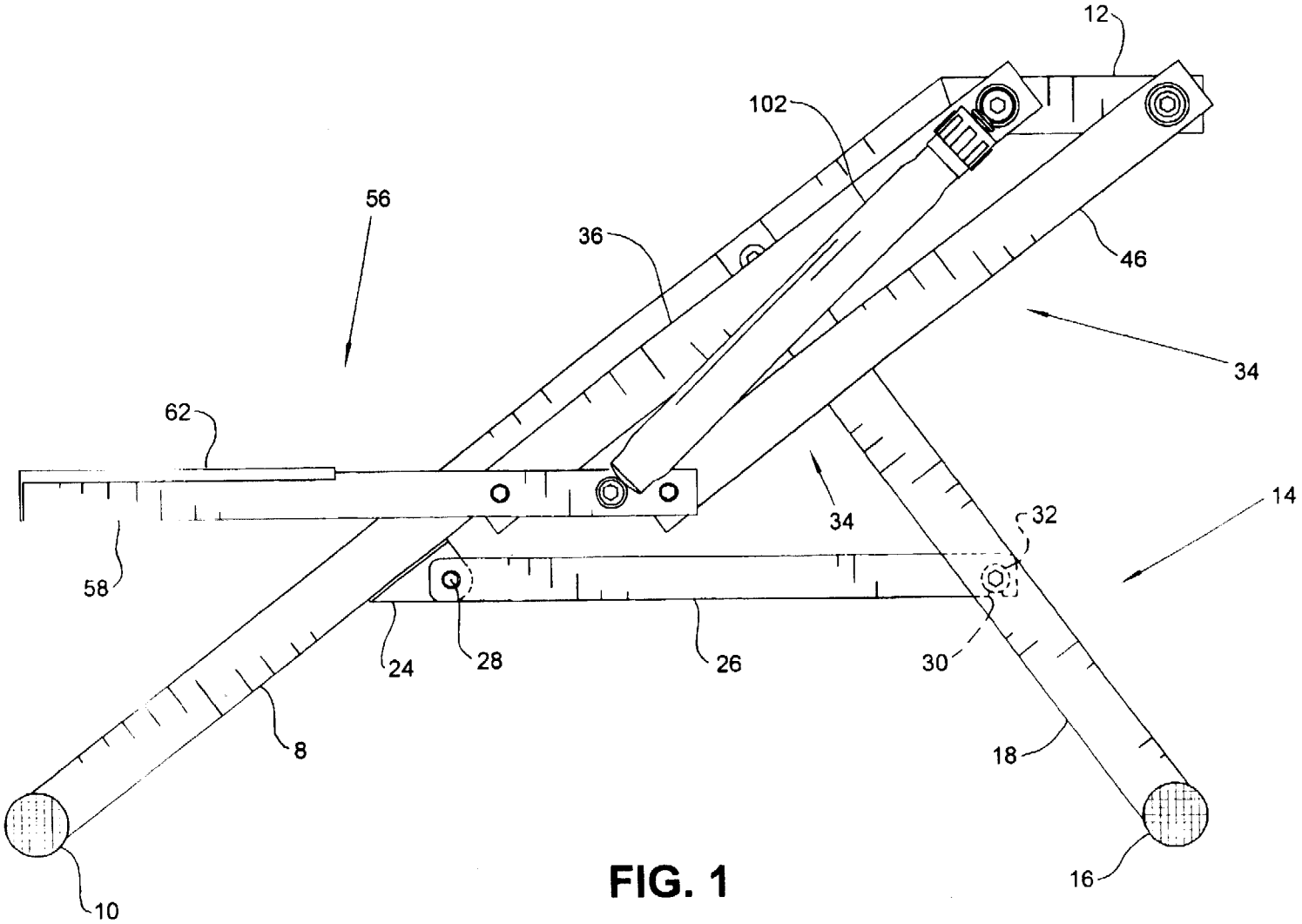
FIG. 1 is a left side elevational view of the machine.

Latch bracket 24 shown in FIGS. 1, 2 and 4 is welded to the back side of the longitudinal frame member 8 approximately halfway between the front lateral base member 10 and rear tail pivot axis 22. The first end of latch member 26 is pivotably mounted to latch bracket 24 about latch pivot axis 28. Opposite the first end of latch member 26 is latch slot 30 for receiving latch pin 32. The latch pin is secured between longitudinal tail members 18 and 20.

After exercising, the rear tail assembly 14 is secured in place by latch member 26 and can quickly and easily rotated forward by lifting latch member 26 from latch pin 32 and rotating rear lateral base member 16 toward longitudinal frame member 8 for quick and easy storage.

The left swing-arm assembly 34 shown in FIGS. 1 and 3 is operable for rotating in principally a forward to rearward motion. The left swing-arm assembly 34 is for supporting the user's left foot in an approximately horizontal position.

The left swing-arm assembly 34 comprises a left first member 36 with a first end welded to upper bearing house 38 and distanced from horizontal frame member 12 by spacer 40 and rotatable about left upper first pivot axis 42 located on horizontal frame member 12. Lower bearing house 44 is welded to the opposite free end of the left first member 36.

The left swing-arm assembly also comprises a left second member 46 with a first end welded to upper bearing house 48 and distanced from horizontal frame member 12 by spacer 50 and rotatable about left upper second pivot axis 52, located on horizontal frame member 12. Lower bearing house 54 is welded to the opposite free end of the left second member 46.

The left swing-arm assembly 34 also comprises a left platform assembly 56 for standing on by the user's left foot. The left platform assembly 56 comprises a left first channel member 58 and left second channel member 60, and a left foot plate 62.

The first ends of the left first and second channel members 58 and 60 respectively, best shown in FIGS. 3 and 4, are pivotably mounted to lower bearing house 44 and 54 about a left lower first pivot axis 64 and left lower second pivot axis 66 respectively. Opposite the first end of left channel member 58 and 60 is mounted left foot plate 62.

The right swing-arm assembly 68 as shown in FIG. 2 and 3 is operable for rotating in principally a forward to rearward motion. The right swing-arm assembly 68 is for supporting the user's right foot in an approximately horizontal position.

The right swing-arm assembly 68 comprises a right first member 70 with a first end welded to upper bearing house 72, and set apart from horizontal frame member 12 by spacer 74, and rotatable about right upper first pivot axis 76 located on horizontal frame member 12. Lower bearing house 78 is welded to the opposite free end of the right first member 70.

The right swing-arm assembly 68 also comprises a right second member 80 with a first end welded to upper bearing house 82, and set apart from horizontal frame member 12 by spacer 84, and rotatable about right upper second pivot axis 86 located on frame member 12. Lower bearing house 88 is welded to the opposite free end of the right second member 80.

The right swing-arm assembly 68 also comprises a right platform assembly 90 for standing on by the user's right foot. The right platform assembly 90 comprises a right first channel member 92, and a right second channel member 94, and a right foot plate 96.

The first ends of the right first and second channel members 92 and 94 respectively, best shown in FIGS. 3 and 4 are pivotably mounted to lower bearing house 78, and 88 about a right lower first pivot axis 98, and a right lower second pivot axis 100 respectively. Opposite the first end of right channel member 92 and 94 is mounted right foot plate 96.

The first end of left resistance cylinder 102 is pivotably mounted to a left upper first pivot axis 42, and its opposite free end is pivotably mounted to a left pivot axis 104. The first end of right resistance cylinder 106 is pivotably mounted to a right upper first pivot axis 76, and its opposite free end is pivotably mounted to a right pivot axis 108. The left and right resistance cylinder 102 and 106 are similar to an automobile shock absorber and biased toward a closed position.

In the several embodiments of this invention illustrated in the figures, like characters are employed to designate like parts.

Figure 5:
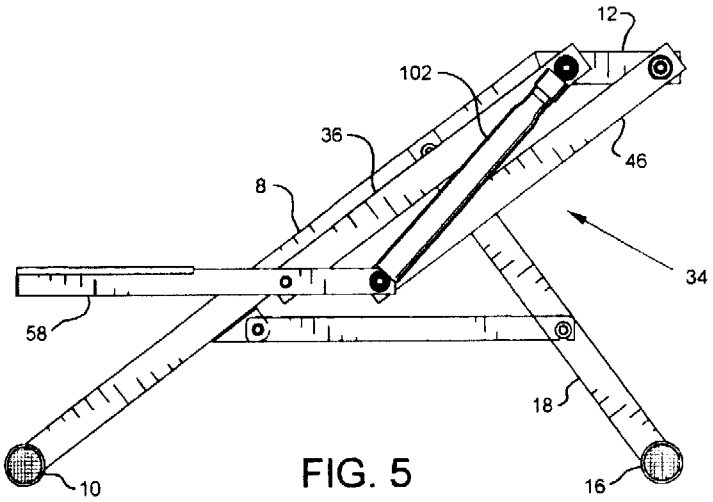
FIG. 5 is a left side elevational view of a second embodiment of the exercise machine the right side elevational view being the mirror image thereof.
Figure 6B:
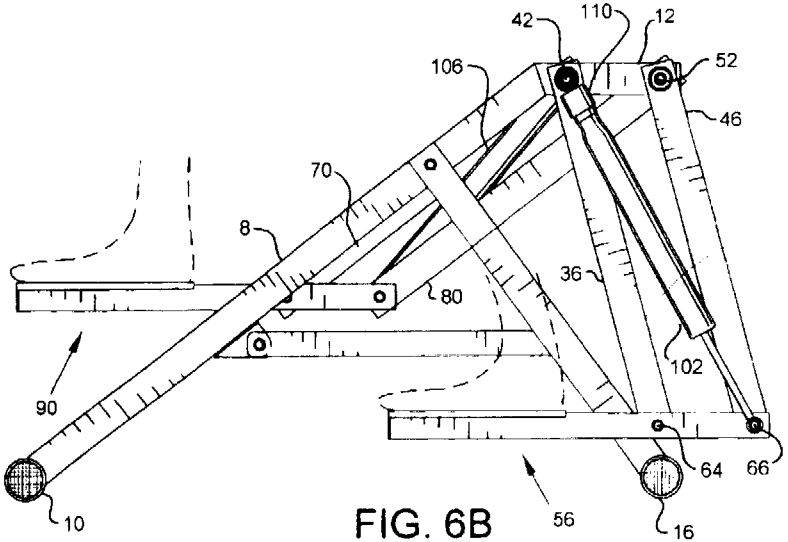
FIG. 6B is a left side elevational view the embodiment of FIG. 5 showing the left platform assembly at its rearwardmost point.
Figure 6A:
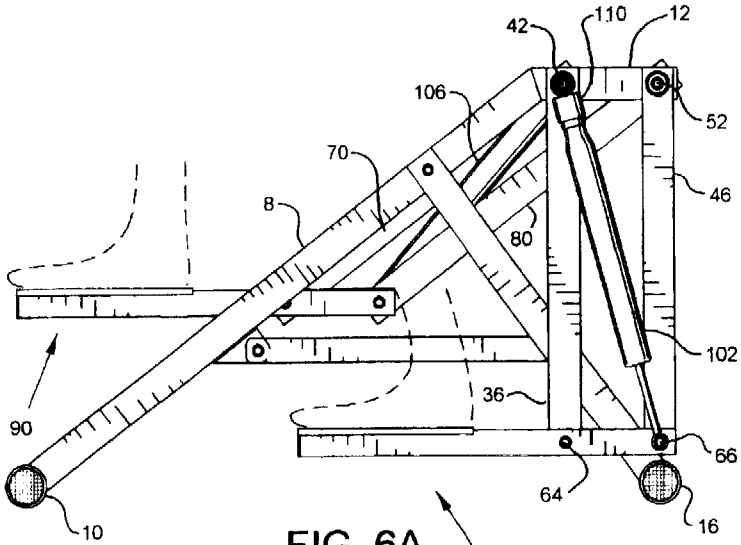
FIG. 6A is a left side elevational view of the embodiment of FIG. 5 showing the left platform assembly at its lowest point.

FIGS. 5, 6A and 6B illustrate a second embodiment of my invention which is similar to the first embodiment of FIGS. 1–4 except as described below FIG. 5 is the left side of this embodiment, the right side being the mirror image of the left side. In FIG. 5 both the left and right platform means are at their forwardmost and uppermost positions.

FIG. 6A shows the left platform assembly at its lowermost position and the right platform assembly at its forwardmost and uppermost position. It is at this position along the fixed path that the user s body weight begins to shift from user's left foot to user's right foot. Similarly the right and left platform assemblies are merely in reversed order as that shown in FIG. 6A when the user's body weight begins to shift from user's right foot to user's left foot. FIG. 6B shows the left platform assembly at its rearwardmost position when the left resistance cylinder is at the end of its extension. The right platform assembly also has a similar rearwardmost position. Usually when the exercise machine is in uses the user's natural walking motion causes the right and left platform assemblies to come to a momentary soft stop at their lowermost positions along the right and left fixed paths as shown in FIG. 6A when the user's body weight is mainly on the user's left foot rather than continuing to their rearwardmost positions. Exactly where the right and left platform assemblies reverse their direction depends on the user's body height the rate at which the user body weight is shifted, and the biasing force and the force exerted by the resistance means, however, usually and ideally this occurs at the lowermost positions along the fixed paths. These conditions are true for all biased embodiments of my invention.

The resistance means preferably is adjustable, which in the figures is effected by turning adjusting collar 110 on the resistance cylinder means.

Figure 7:
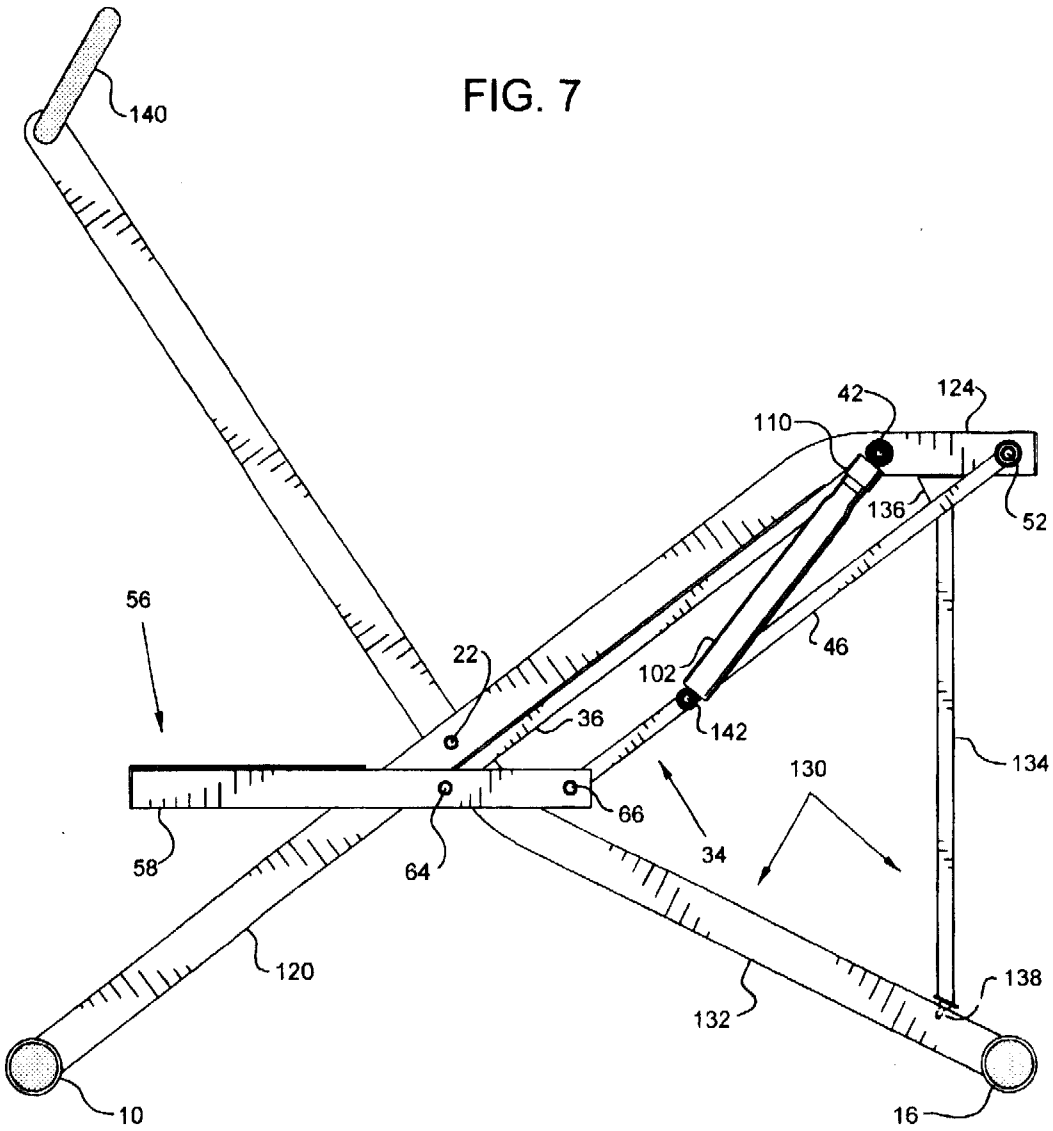
FIG. 7 is a left side elevational view of a third embodiment of this invention.
Figure 8:
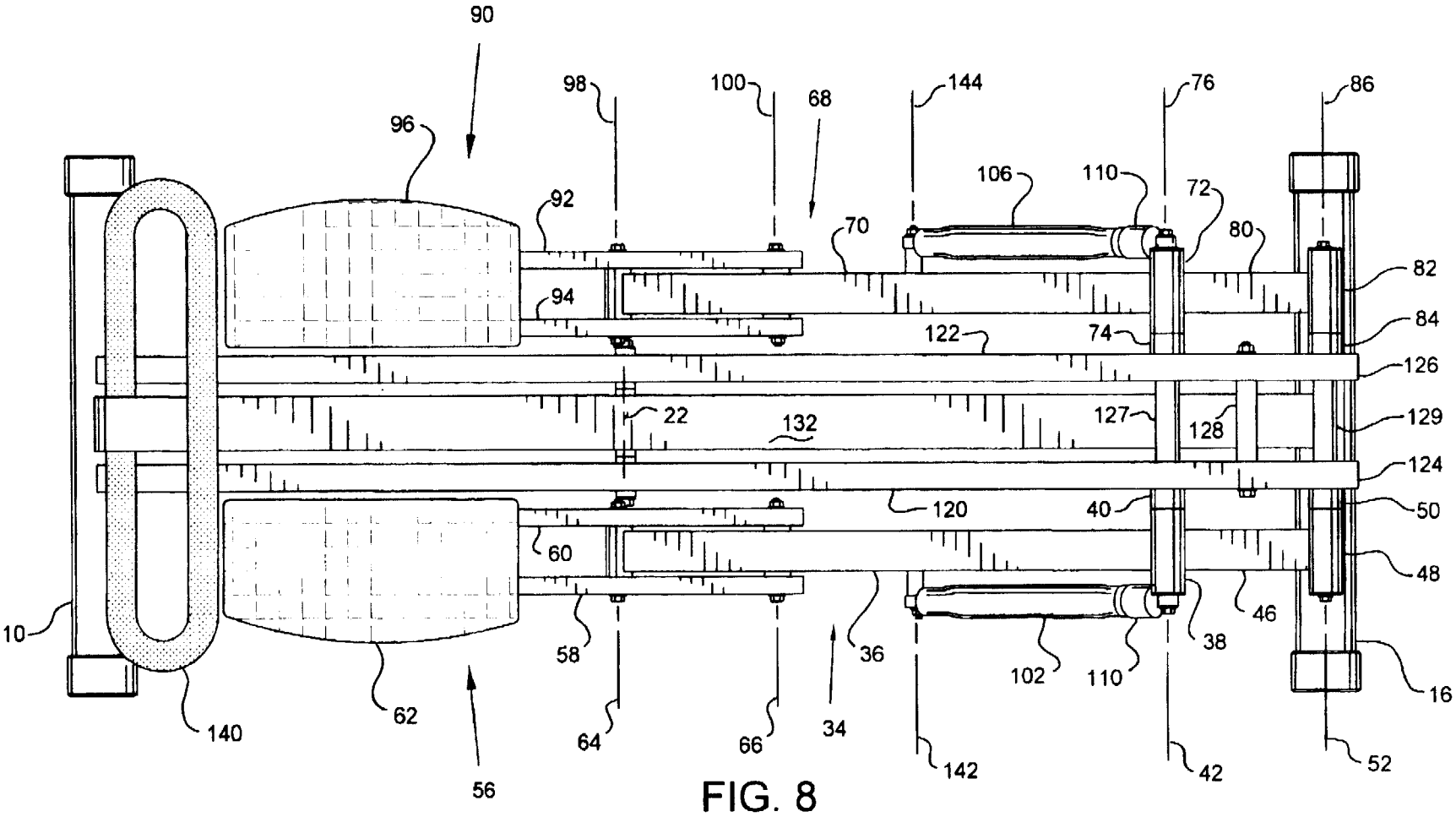
FIG. 8 is a top plan view of the exercise machine of FIG. 7.

FIGS. 7 and 8 show a third embodiment of this invention with a modified frame and a modified rear tail assembly with a handgrip which extends upwardly to about the user's waist level. In this embodiment, the frame comprises left longitudinal frame member 120 and right longitudinal frame member 122 which are spaced apart and welded at their front and lower ends to front lateral base frame member 10 at about its midpoint. The rear and upper ends of members 120 and 122 are bent slightly downward thereby forming left and right horizontal frame portions 124 and 126, respectively. Swing arm assemblies 34 and 68 are pivotally mounted to left and right frame portions 124 and 126 in a similar manner as the swing arm assemblies were mounted to horizontal frame member 12 in the embodiment of FIGS. 1–5, 6A and 6B. Swing arm assemblies 34 and 68 are pivotally mounted about upper first pivot axis shaft 127 and upper second pivot axis shaft 129 to left and right platform assemblies 56 and 90, respectively, in a similar manner as the swing arm assemblies were mounted in the embodiment of FIGS 1–5, 6A and 6B. Shafts 127 and 129 separate, and are welded to, horizontal frame portions 124 and 126.

Rear tail assembly 130 comprises longitudinal tail member 132 and vertically disposed brace 134. Tubular spacer 128 is secured to brace 134 at its upper end. Brace 134 is pivotally connected by a bolt which passes through a left bracket 136, tubular spacer 128 and a right bracket (not shown); and the two brackets are secured to the underside of frame portions 124 and 126. When the machine is in use, the lower end brace 120 is inserted into cavity 138 in longitudinal tail member 132. Longitudinal tail member 132 is pivotally mounted about axis 22, and disposed between left and right longitudinal frame members 120 and 122. Longitudinal tail member 132 is bent slightly upwardly at a point below axis 22 so that handgrip 140 fasten to the upper end of longitudinal tail member 132 is positioned at about the average adult user's waist level.

In this embodiment, left resistance cylinder 102 is pivotally disposed between left frame portion 124 about axis 42 and second left member 46 of swing arm assembly 34 about axis 142 which is located from axis 66 about one-fourth the length of second left member 46. Similarly, right resistance cylinder 106 is pivotally disposed between right frame portion 126 about axis 76 and second right member 80 of swing arm assembly 68 about axis 144 which is located from axis 100 about one-fourth the length of second left member 90.

Figure 9:
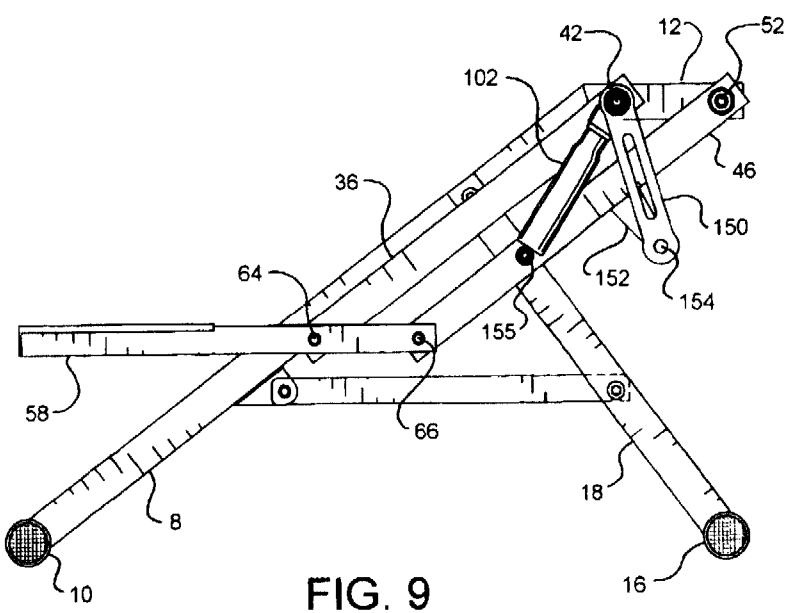
FIG. 9 is a left side elevational view of a fourth embodiment of this invention.

FIG. 9 is a fourth embodiment of my invention showing the left side thereof with the left platform means in its forwardmost and uppermost position, the right side being the mirror image of the left side. The embodiment of FIG. 9 is similar to the first embodiment of FIGS. 1–4 and the second embodiment of FIGS. 5, 6A and 6B except as described below In this embodiment, the left resistance means 102 and right resistance means 106 (not shown) are resistance cylinders which resist rearward movement of the platform means, however, the resistance cylinder are not biased toward the left and right forwardmost and uppermost positions. The left and right resistance cylinder means are pivotally connected at the top about axes 42 and 76 in a similar manner as in the embodiment of FIGS. 1–4. However, left resistance cylinder means 102 is pivotally connected at its bottom about a lower shaft and axis means 155 extending from second left member 46 in a manner similar to the embodiment of FIGS. 5, 6A and 6B. Right resistance cylinder means 106 is pivotally connected at its bottom about a lower shaft and axis means extending from second right member 80, similar to that of the left side.

Biasing of the left platform means towards the left forwardmost and uppermost positions is provided by left spring means 150 which is pivotally connected at its upper end about axis 42 and pivotally connected at its lower end about lower axis means 154. Axis means 154 is secured on spring bracket 152 which is attached to member 46. Biasing of the right platform means is achieved in the same manner as the biasing of the left platform means using similar components.

Figure 10:
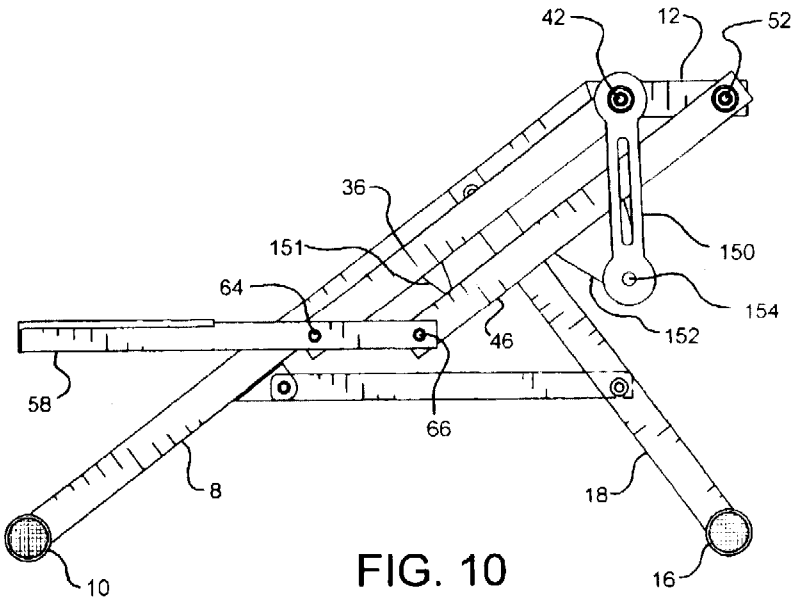
FIG. 10 is a left side elevational view of a fifth embodiment of this invention.

FIG. 10 is a fifth embodiment of my invention showing the left side thereof with the left platform means in its forwardmost and uppermost position, the right side being the mirror image of the left side. The embodiment of FIG. 10 is similar to the fourth embodiment of FIG. 9 except as described below. In this embodiment, the left resistance means for resisting rearward movement of the left platform means and the biasing of the left platform means towards the left forwardmost and uppermost positions is provided by a stronger left spring means 150. Means 150 can be a strong elastic band as used with some exercise equipment or a metal spring but is preferably elastic. Return bumper 151 mounted on member 36 prevents members 36 and 46 from abutting. Resisting rearward movement of the right platform means and the biasing of the the right platform means is achieved in the same manner as for the left platform means.

Figure 12:
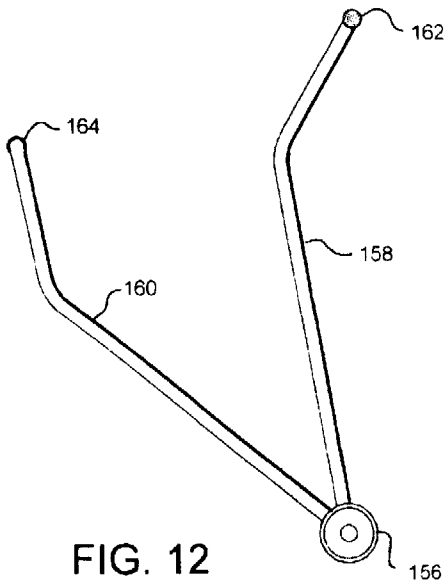
FIG. 12 is a left side elevational view of a detail of the resistance means for the handle bars of FIG. 11.
Figure 11:
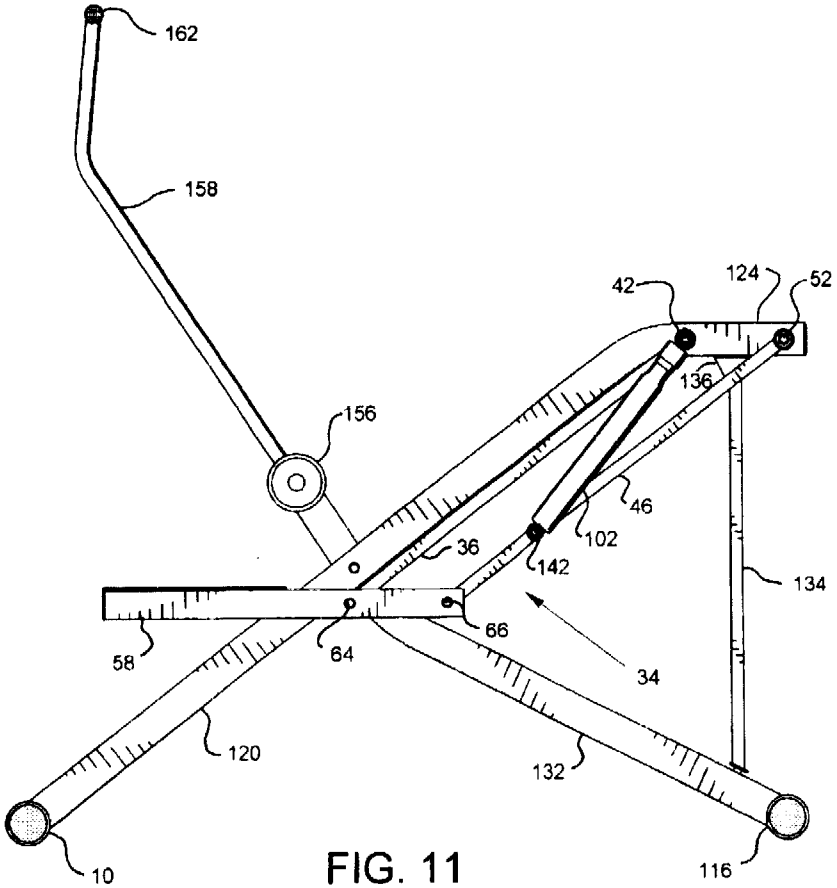
FIG. 11 is a left side elevational view of a sixth embodiment of this invention.

A sixth embodiment of my invention with upper body exercising components is shown in FIGS. 11 and 12 which is similar to the embodiment of FIGS. 7 and 8 except as follows. An upper body assembly which comprises adjustable independent left and right friction assemblies 156, left arm 158, right arm 160, left hand grip 162 and right hand grip 164. The upper body assembly is secured to the top of longitudinal tail member 132.

Figure 13:
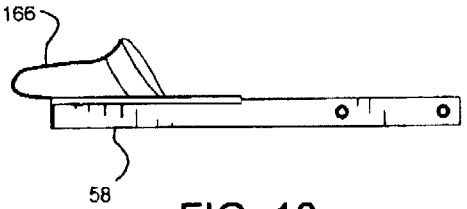
FIG. 13 is a side elevational view of a detail of a boot fasten to a left and right platform assembly.

In the upper body detail shown in FIG. 13, a sleeve for receiving user's foot is provided on each platform means.

In one embodiment the right rearmost terminal position of right platform means is no more than a small distance to the rear of the lowermost position along the right fixed path; and the left rearmost terminal position of the left platform means is no more than a small distance to the rear of the lowermost position along the left fixed path. In a further embodiment, these small distances are such that the lower pivot axis are displaced by no more than about 15 degrees to the rear of the upper pivot axes.

In one embodiment, the forwardmost and uppermost position of the platform means is such that the lower pivot axes are displaced by no more than about 60 degrees to the front of the upper pivot axes.

Adjustable resistance cylinders are disclosed in U.S. Pat. No. 4,591,032 which is hereby incorporated herein by reference.

While the preferred embodiment of the present invention has been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. A non-impact exercise machine for simulating walking comprising:

a frame;

right platform manias for supporting user's right foot;

right linkage means having an upper end pivotally connected about non-moving right upper pivot axes to the frame, and a lower end pivotally connected about moving right lower pivot axes to the right platform means, wherein the distances from the right upper pivot axes to the right lower pivot axes are fixed lengths, the right linkage means for moving the right platform means over a right fixed path below the right upper pivot axes while maintaining the right platform means approximately horizontal, the right fixed path having a right forwardmost and uppermost terminal position and a right rearmost terminal position;

left platform means for supporting user's left foot; and left linkage means having an upper end pivotally connected about non moving left upper pivot axes to the frame, and a lower end pivotally connected about moving left lower pivot axes to the left platform means, wherein the distances from the left upper pivot axes to the left lower pivot axes are fixed lengths, the left linkage means for moving the left platform means over a left fixed path below the left upper pivot axes while maintaining the left platform means approximately horizontal, the left fixed path having a left forwardmost and uppermost terminal position and a left rearmost terminal position;

bias means for returning the right platform means to the right forwardmost and uppermost terminal position when there is no downward external force on the right platform means and for returning the left platform means to the left forwardmost and uppermost terminal position when there is no downward external force on the left platform means; and resistance means for resisting rearward movement of the right platform means along the right fixed path and the left platform means along the left fixed path.

2. The exercise machine of claim 1, wherein the horizontal movement of the right platform means between the right forwardmost and uppermost terminal position and the right rearmost terminal position is greater than the vertical movement between the right forwardmost and uppermost terminal position and the right rearmost terminal position, and wherein the horizontal movement of the left platform means between the left forwardmost and uppermost terminal position and the left rearmost terminal position is greater than the vertical movement between the left forwardmost and uppermost terminal position and the left rearmost terminal position.

3. The exercise machine of claim 1, further comprising means for quickly collapsing the exercise machine for storage.

4. The exercise machine of claim 1, further comprising means for quickly collapsing the exercise machine for storage by folding the frame.

5. The exercise machine of claim 1, wherein the resistance means and the bias means comprise a right shock absorber biased toward its closed position, and a left shock absorber biased toward its closed position.

6. The exercise machine of claim 1, wherein the resistance means and the bias means comprise a right shock absorber biased toward its closed position and pivotally connected to the frame and the right platform means, and a left shock absorber biased toward its closed position and pivotally connected to the frame and the left platform means.

7. The exercise machine of claim 1, whereby, when the machine is in use, the shift of the users weight to the user's right foot causes the right platform means to move along the right fixed path to about the lowest point along the right fixed path and to stop there until the user's weight is shifted to the user's left foot; and the shift of the users weight to the user's left foot causes the left platform means to move along the left fixed path to about the lowest point along the left fixed path and to stop there until the user's weight is shifted to the user's right foot, thereby simulating walking.

8. The exercise machine of claim 2, whereby, when the machine is in use, the shift of the user's weight to the user's right foot causes the right platform means to move along the right fixed path to about the lowest point along the right fixed path and to stop there until the user's weight is shifted to the user's left foot; and the shift of the user's weight to the user's left foot causes the left platform means to move along the left fixed path to about the lowest point along the left fixed path and to stop there until the user's weight is shifted to the user's right foot, thereby simulating walking.

9. A non-impact exercise machine for simulating walking comprising:

a frame;

right platform means for supporting user's right foot;

right swing arm assembly having a right first member and a right second member, the right first member having an upper end pivotally connected about a non-moving right upper first pivot axis to the frame, and a lower end pivotally connected about a moving right lower first pivot axis to the right platform means, wherein the distance between the right upper first pivot axis and right lower first pivot axis is a fixed length, the right second member having an upper end pivotally connected about a non-moving right upper second pivot axis to the frame, and a lower end pivotally connected about a moving right lower second pivot axis to the right platform means, wherein the distance between the right upper second pivot axis and right lower second pivot axe is a fixed length, the right swing arm assembly for moving the right platform means over a right fixed path below the right upper first and second pivot axes while maintaining the right platform means approximately horizontal, the right fixed path having a right forwardmost and uppermost terminal position and a right rearmost terminal position;

left platform means for supporting user's left foot;

left swing arm assembly having a left first member and a left second member, the left first member having an upper end pivotally connected about a non-moving left upper first pivot axis to the frame, and a lower end pivotally connected about a moving left lower first pivot axis to the left platform means, wherein the distance between the left upper first pivot axis and left lower first pivot axis is a fixed length, the left second member having an upper end pivotally connected about a non-moving left upper second pivot axis to the frames and a lower end pivotally connected about a moving left lower second pivot axis to the left platform means, wherein the distance between the left upper second pivot axis and left lower second pivot axis is a fixed length, the left swing arm assembly for moving the left platform means over a left fixed path below the left upper first and second pivot axes while maintaining the left platform means approximately horizontal, the left fixed path having a left forwardmost and uppermost terminal position and a left rearmost terminal position;

bias means for returning the right platform means to the right forwardmost and uppermost terminal position when there is no downward external force on the right platform means and for returning the left platform means to the left forwardmost and uppermost terminal position when there is no downward external force on the left platform means; and resistance means for resisting rearward movement of the right platform means along the right fixed path and the left platform means along the left fixed path, thereby, when the machine is in use, simulating walking.

10. The exercise machine of claim 9, wherein the fixed lengths defined by (i.) the distance between the right upper first pivot axis and right lower first pivot axis, (ii.) the distance between the right upper second pivot axis and right lower second pivot axis, (iii.) the distance between the left upper first pivot axis and left lower first pivot axis, and (iv.) the distance between the left upper second pivot axis and left lower left pivot axis, are about equal in length.

11. The exercise machine of claim 9, wherein the resistance means and the bias means comprise a right shock absorber biased toward its closed position, and a left shock absorber biased toward its closed position.

12. The exercise machine of claim 9, wherein the resistance means and the bias means comprise a right shock absorber biased toward its closed position and pivotally connected to the frame and the right platform means, and a left shock absorber biased toward its closed position and pivotally connected to the frame and the left platform means.

13. The exercise machine of claim 9, wherein the resistance means and the bias means comprise a right shock absorber biased toward its closed position and pivotally connected to the frame and the right swing arm assembly, and a left shock absorber biased toward its closed position and pivotally connected to the frame and the left swing arm assembly.

14. The exercise machine of claim 9, further comprising means for quickly collapsing the exercise machine for storage.

15. The exercise machine of claim 9, whereby, when the machine is in use, the shift of the user's weight to the user's right foot causes the right platform means to move along the right fixed path to about the lowest point along the right fixed path and to stop there until the user's weight is shifted to the user's left foot; and the shift of the user's weight to the user's left foot causes the left platform means to move along the left fixed path to about the lowest point along the left fixed path and to stop there until the user's weight is shifted to the user's right foot, thereby simulating walking.

16. A non-impact exercise machine for simulating walking comprising:

a frame;

right platform means for supporting user's right foot;

right linkage means having an upper end pivotally connected about non-moving right upper pivot axes to the frame, and a lower end pivotally connected about moving right lower pivot axes to the right platform means, wherein the distances from the right upper pivot axes to the right lower pivot axes are fixed lengths, the right linkage means for moving the right platform means over a right fixed path below the right upper pivot axes while maintaining the right platform means approximately horizontal, the right fixed path having a right forwardmost and uppermost terminal position and a right rearmost terminal position;

the horizontal movement of the right platform means between the right forwardmost and uppermost terminal position and the right rearmost terminal position being greater than the vertical movement between the right forwardmost and upper no terminal position and the right rearmost terminal position;

left platform means for supporting user's left foot;

left linkage means having an upper end pivotally connected about non-moving left upper pivot axes to the frames and a lower end pivotally connected about moving left lower pivot axes to the left platform means, wherein the distances from the left upper pivot axes to the left lower pivot axes are fixed lengths which is equal to the first mentioned fixed lengths, the left linkage means for moving the left platform means over a left fixed path below the left upper pivot axes while maintaining the left platform means approximately horizontal, the left fixed path having a left forwardmost and uppermost terminal position and a left rearmost terminal position;

the horizontal movement of the left platform means between the left forwardmost and uppermost terminal position and the left rearmost terminal position being greater than the vertical movement between the left forwardmost and uppermost terminal position and the left rearmost terminal position;

right bias means for returning the right platform means to the right forwardmost and uppermost terminal position when there is no downward external force on the right platform means;

left bias means for returning the left platform means to the left forwardmost and uppermost terminal position when there is no external force on the left platform means;

right resistance means for resisting rearward movement of the right platform means along the right fixed path; and left resistance means for resisting rearward movement of the left platform means along the left fixed path, thereby, when the machine is in use, simulating walking.

17. The exercise machine of claim 16, wherein the right resistance means and the right bias means comprise a right shock absorber biased toward its closed position, and the left resistance means and the left bias means comprise a left shock absorber biased toward its closed position.

18. The exercise machine of claim 17, wherein the right shock absorber is pivotally connected to the frame and the right platform means, and a left shock absorber is pivotally connected to the frame and the left platform means.

19. The exercise machine of claim 17, further comprising means for quickly collapsing the exercise machine for storage by folding the frame.

20. The exercise machine of claim 19, whereby, when the machine is in use, the shift of the user's weight to the user's right foot causes the right platform means to move along the right fixed path to about the lowest point along the right fixed path and to stop there until the user's weight is shifted to the user's left foot; and the shift of the user's weight to the user's left foot causes the left platform means to move along the left fixed path to about the lowest point along the left fixed path and to stop there until the user's weight is shifted to the user's right foot, thereby simulating walking.

21. A non-impact exercise machine for simulating walking comprising:

a frame;

right platform means for supporting user's right foot;

right linkage means having an upper end pivotally connected about right upper pivot axes to the frame, and a lower end pivotally connected about right lower pivot axes to the right platform means, wherein the distances from the right upper pivot axes to the right lower pivot axes are fixed lengths, the right linkage means for moving the right platform means over a right fixed path while maintaining the right platform means approximately horizontal, the right fixed path having a right forwardmost and uppermost terminal position and a right rearmost terminal position, the right rearmost terminal position being no more than about 15° to the rear of the right upper pivot axes;

left platform means for supporting user's left foot; and left linkage means having an upper end pivotally connected about left upper pivot axes to the frame, and a lower end pivotally connected about left lower pivot axes to the left platform means, wherein the distances from the left upper pivot axes to the left lower pivot axes are fixed lengths, the left linkage means for moving the left platform means over a left fixed path while maintaining the left platform means approximately horizontal, the left fixed path having a left forwardmost and uppermost terminal position and a left rearmost terminal position, the left rearmost terminal position being no more than about 15° to the rear of the left upper pivot axes; and bias means for returning the right platform means to the right forwardmost and uppermost terminal position when there is no downward external force on the right platform means and for returning the left platform means to the left forwardmost and uppermost terminal position when there is no downward external force on the left platform means.

22. The non-impact exercise machine for simulating walking of claim 21, wherein the right forwardmost and uppermost position of the right platform means is such that the right lower pivot axes are displaced by no more than about 60° to the front of the right upper pivot axes; and wherein the left forwardmost and uppermost position of the left platform means is such that the left lower pivot axes are displaced by no more than about 60° to the front of the left upper pivot axes.

* * * * *